US005470030A

United States Patent [19]

Nielsen et al.

[11] Patent Number: 5,470,030

[45] Date of Patent: Nov. 28, 1995

[54] FABRIC TAKE-UP FRAME FOR A TEXTILE FABRIC PRODUCING MACHINE

[75] Inventors: Arne Nielsen, Oak Ridge; Majid Moghaddassi; Boris Vishnepolsky, both of Greensboro; Keith Smith, High Point, all of N.C.

[73] Assignee: Guilford Mills, Inc., Greensboro, N.C.

[21] Appl. No.: 169,702

[22] Filed: Dec. 17, 1993

[51] Int. Cl.[6] ..... B65H 18/10; B65H 23/10

[52] U.S. Cl. ..... 242/533.8; 242/413.3

[58] Field of Search ..... 242/412, 413, 242/413.3, 413.4, 413.5, 533, 533.6, 533.8, 534, 539, 547, 548

[56] References Cited

U.S. PATENT DOCUMENTS

| | | | |
|---|---|---|---|
| 2,501,985 | 3/1950 | Benjamin | 242/573.4 |
| 2,569,589 | 10/1951 | Trissell | 242/533.8 |
| 2,729,079 | 1/1956 | Kuehn | 242/413 |
| 3,031,152 | 4/1962 | Cohen et al. | 242/413.5 |
| 3,044,726 | 7/1962 | Schellenberg | 242/533.8 |
| 3,796,390 | 3/1974 | Melead | 242/413.4 |
| 3,927,844 | 12/1975 | Bond et al. | 242/413.5 |
| 3,976,258 | 8/1976 | Ruscher | 242/413.5 |
| 4,130,014 | 12/1978 | Eddens . | |
| 4,177,410 | 12/1979 | Dowd . | |
| 4,199,118 | 4/1980 | Tetro et al. . | |
| 4,216,804 | 8/1980 | Alexander, III et al. | 242/413.5 |
| 4,280,081 | 7/1981 | Dinger et al. . | |
| 4,347,993 | 9/1982 | Leonard . | |
| 4,489,900 | 12/1984 | Morizzo | 242/533.8 |
| 4,574,845 | 3/1986 | Alexander, III | 242/533.8 |
| 4,708,301 | 11/1987 | Kataoka . | |
| 4,916,783 | 4/1990 | Hagewood et al. . | |
| 5,022,599 | 6/1991 | Nakade . | |
| 5,028,011 | 7/1991 | Schiffers | 242/533.8 |
| 5,031,666 | 7/1991 | Raaijmakers et al. | 242/533.8 |
| 5,035,373 | 7/1991 | Perrigo | 242/547 |
| 5,056,730 | 10/1991 | Buckle | 242/547 |
| 5,157,948 | 10/1992 | Rikiishi | 242/532.5 |
| 5,282,584 | 2/1994 | Yano | 242/533.8 |
| 5,299,753 | 4/1994 | Alexander, III | 242/547 |

*Primary Examiner*—Daniel P. Stodola
*Assistant Examiner*—John P. Darling
*Attorney, Agent, or Firm*—Shefte, Pinckney & Sawyer

[57] ABSTRACT

An apparatus for take-up of textile fabric from a fabric producing machine is equipped with a fabric take-up frame, a fabric take-up roll supported on the frame for fabric winding thereabout, and a variable speed drive motor arrangement for rotating the take-up roll. A transducer roll or other suitable arrangement monitors tension in the fabric between the fabric producing machine and the take-up frame and is associated with a microprocessor or other controller to adjust the drive motor speed as necessary to maintain fabric tension in accordance with a predetermined tension program as the fabric is wound on the take-up roll, either for purposes of maintaining constant fabric tension or programmed tension variation over the winding operation. The take-up frame is separable from and movable independently of the fabric producing machine for transporting a fabric after a take-up operation to a subsequent processing station without rewinding of the fabric. In other embodiments, the fabric producing machine may be disposed at an elevation directly above the take-up apparatus or vice versa.

7 Claims, 10 Drawing Sheets

FABRIC TAKE-UP FRAME FOR A TEXTILE FABRIC PRODUCING MACHINE

BACKGROUND OF THE INVENTION

The present invention relates generally to apparatus and mechanisms for the winding take-up of a traveling textile fabric and, more particularly, to an apparatus for combination directly with a textile fabric producing machine, especially warp knitting machines.

Conventional warp knitting machines, like many other textile fabric producing machines, are equipped with a fabric take-up mechanism to which the knitted fabric is directed for winding onto a roll. In the ongoing operation of the machine, the roll of wound fabric is periodically doffed from the take-up mechanism once the roll reaches its predetermined capacity. The roll of fabric is then transported to another location for further processing, such as dyeing, bleaching, or other wet processing operations, mechanical treatments such as brushing, napping, tigering, or shearing operations, etc.

One of the significant disadvantages of conventional warp knitting machinery is the inherent limitation on their capacity for take-up winding of the knitted fabric produced on the machine, which limitation is a direct result of the limited ability of the machines to monitor and control tension in the fabric during the winding operation. The known conventional warp knitting machines typically utilize a dancer roll mechanism for controlling fabric tension, but as those persons skilled in the art will recognize, dancer roll mechanisms are essentially only capable of providing relatively rough control of fabric tension by ensuring a minimum tension level is maintained. Further, dancer roll mechanisms do not provide the ability to adjustably vary fabric tension over the course of the winding operation, which would be advantageous with some types of fabrics, e.g., pile and plush surface fabrics. This inability for precise programmable tension control in warp knitting machine take-up mechanisms necessarily limits the maximum capacity to which the fabric can be wound without risking damage to the fabric.

On the other hand, it would be highly desirable for warp knitting machines to be appropriately equipped with a take-up mechanism capable of precise and programmable tension control to enable the take-up capacity of the machines to be substantially increased and, in turn, to enable the subsequent processing of the fabric to be handled in larger quantities and without any intermediate step of rewinding the fabric on another roll or support. It would be especially beneficial in this regard to be able to wind textile fabric at the take-up of the knitting or other fabric producing machine directly onto a dyeing tube or roll so that the wound fabric could subsequently be transported directly to a dyeing station without any intermediate handling or processing of the fabric. In any case, significant improvements in fabric producing efficiency and reductions in manufacturing costs would be realized.

SUMMARY OF THE INVENTION

It is accordingly an object of the present invention to provide a fabric take-up apparatus particularly adapted for use in combination with a textile fabric producing machine such as a warp knitting machine, with the capability of regulating fabric tension so as to provide a substantially increased capacity for take-up winding of the fabric production of the machine in comparison to the conventional take-up mechanisms of such machines.

Briefly summarized, the take-up apparatus of the present invention accomplishes the foregoing objectives by providing a fabric take-up frame which is separable from and movable independently of the fabric producing machine so that, after a fabric take-up operation, the fabric may be transported to a subsequent processing station without rewinding of the fabric. More particularly, a fabric take-up roll is supported on the frame for winding of the fabric about the roll and a drive motor or other suitable means is provided for variably driving rotation of the take-up roll. An appropriate device or means monitors tension in the fabric between the fabric producing machine and the take-up frame and is operatively associated with a device which controls the drive to the take-up roll to maintain tension in the fabric according to a predetermined tension program as the fabric is wound on the take-up roll, thereby to provide precise programmable control of the fabric tension so as to enable the take-up capacity of the apparatus to be maximized. By way of example, the tension program of the drive controller may be operative to maintain a substantially constant tension in the fabric as it is wound on the take-up roll or, alternatively, may be operable to vary the tension in the fabric as winding on the take-up roll progresses.

Preferably, the tension monitoring means utilizes a take-off roll located adjacent the fabric producing machine for peripherally contacting the fabric and an associated transducer for detecting deflections of the take-off roll resulting from fabric tension fluctuations.

The fabric is peripherally applied to the take-up roll, preferably by means of a fabric application roll for peripherally contacting the outer layer of fabric on the take-up roll with a predetermined force of contact thereagainst. The fabric application roll is supported for controlled movement toward and away from the take-up roll in relation to the diametric dimension of the wound fabric on the take-up roll. For example, the fabric application roll may be connected to a fluid-actuated piston-and-cylinder assembly wherein extension and withdrawal of the piston is controlled based upon monitoring of the internal fluid pressure within the assembly so as to maintain the fluid pressure substantially constant.

In the preferred embodiment, the fabric application roll should be disposed to contact the take-up roll at a peripheral location thereon facing the take-off roll of the fabric producing machine so as to reduce the distance of fabric travel between the take-off and take-up rolls.

It is further preferred that the drive for the take-up roll comprise a drive frame which is separable from the take-up frame, with the drive motor being mounted to the drive frame and including an appropriate mechanism or other means for selectively connecting and disconnecting the drive motor to and from the take-up roll.

By the provision of an independent fabric take-up apparatus which is separable from the textile fabric producing machine, various arrangements of the fabric producing machine in relation to the take-up apparatus are made possible. For example, the take-up apparatus and the fabric producing machine may be situated side-by-side one another. Alternatively, the fabric producing machine may be disposed at an elevation generally above the take-up apparatus, in which case the take-up frame may advantageously be disposed for lateral movement between a winding position for receiving fabric from the fabric producing machine and a doffing position for unloading the take-up roll from the frame. As a further alternative, the fabric take-up apparatus may be disposed at an elevation generally above the fabric producing machine, whereby an elevated transport apparatus may be utilized for unloading and conveying the take-up roll from the fabric take-up frame.

DESCRIPTION OF THE PREFERRED EMBODIMENT

Figure 1:
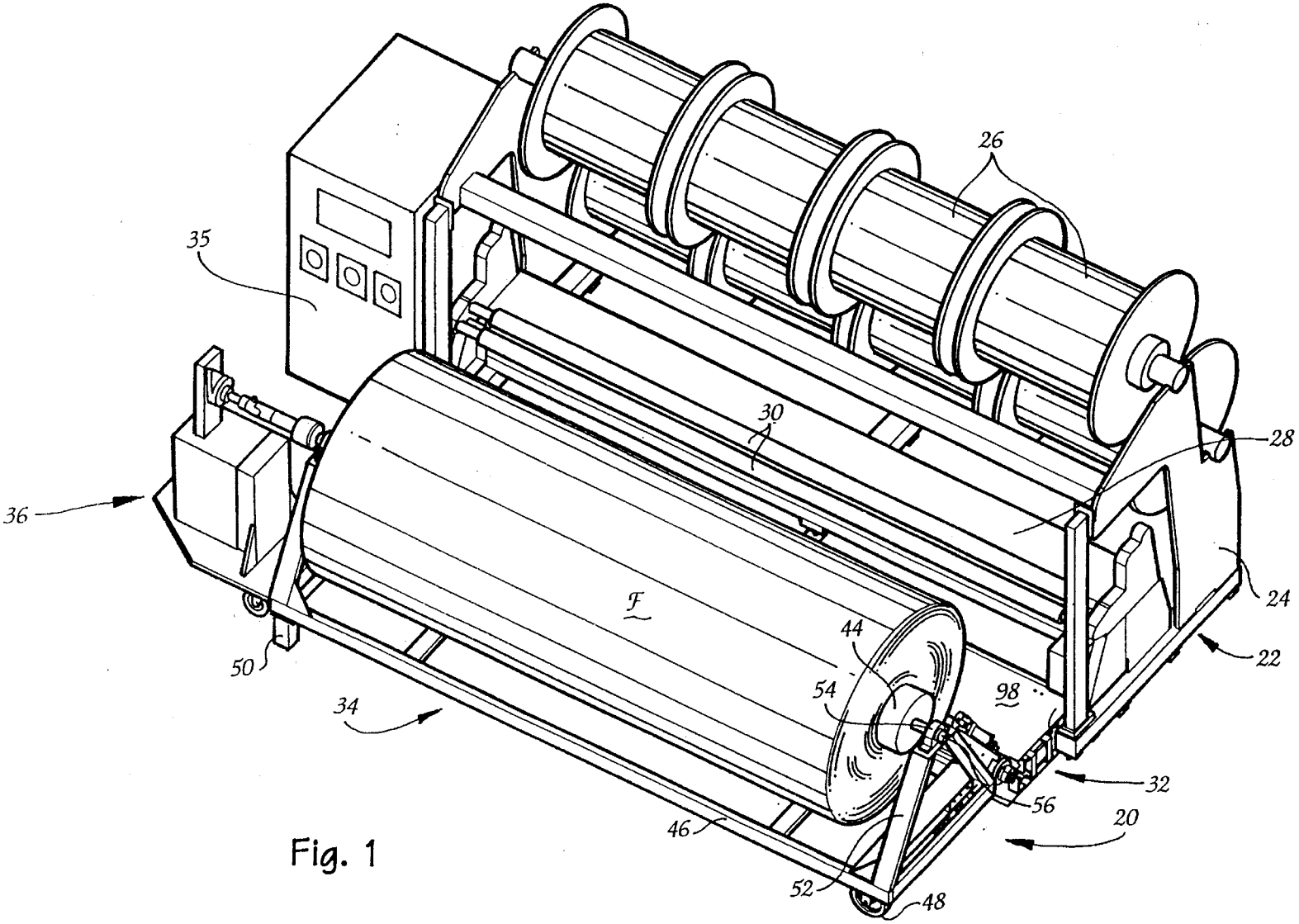
FIG. 1 is a perspective view of one preferred embodiment of the fabric take-up apparatus of the present invention in combination with a conventional textile warp knitting machine.
Figure 2:
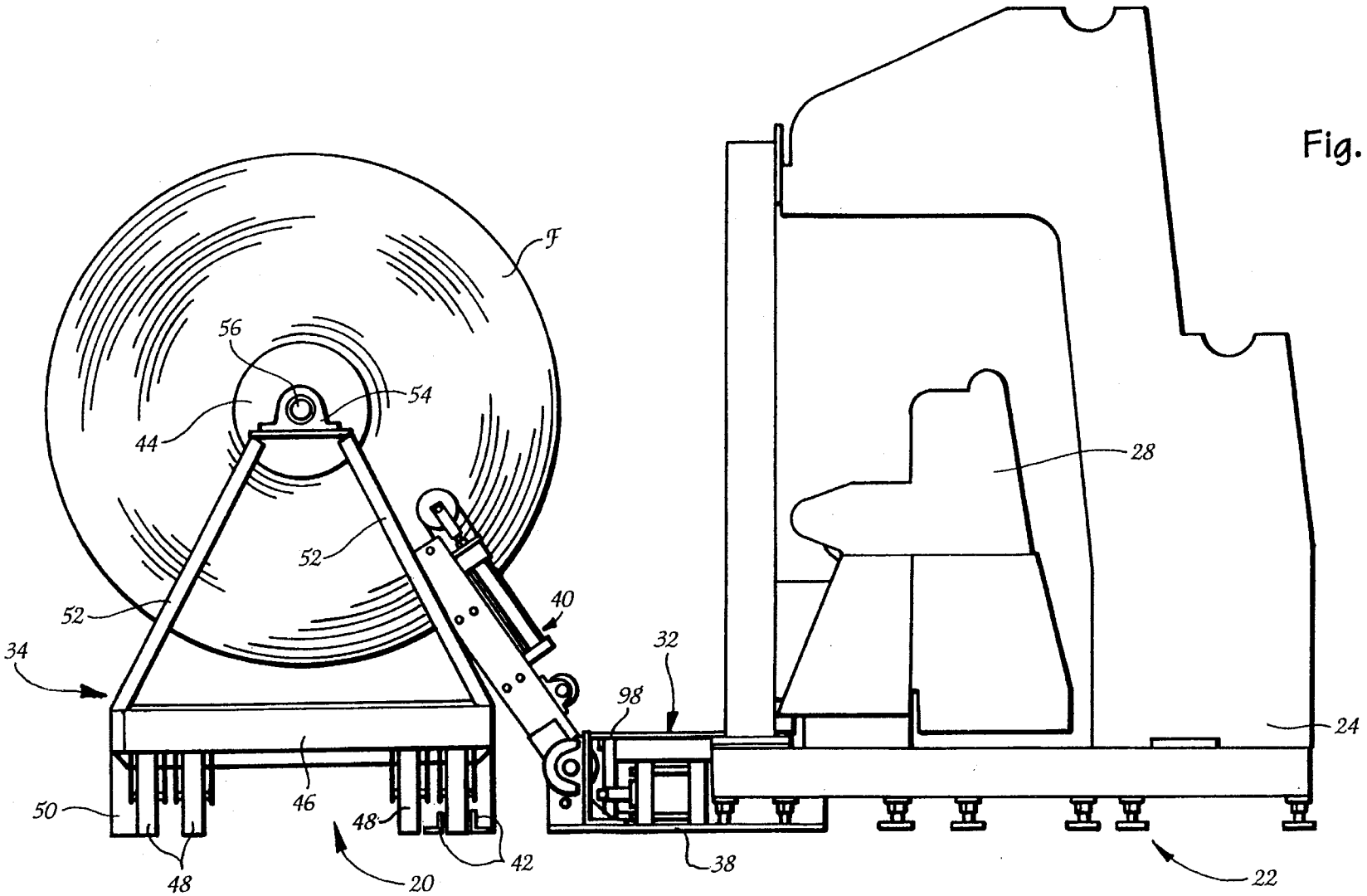
FIG. 2 is an end elevational view of the combined take-up apparatus and warp knitting machine of FIG. 1.

Referring now to the accompanying drawings and initially to FIGS. 1 and 2, the fabric take-up apparatus of the present invention is shown generally at 20 in the form of one preferred embodiment particularly adapted for use in combination with a conventional textile warp knitting machine, indicated representatively at 22. Since the warp knitting machine is substantially conventional, the basic construction and operation of which are well-known, a detailed description of the warp knitting machine 22 should be unnecessary. Basically, the warp knitting machine 22 comprises an elongated frame 24 supporting at its upper side a series of warp beams 26 having a plurality of yarns wound thereon in side-by-side parallel relation for delivery to a knitting mechanism, shown only representatively at 28, typically comprising an arrangement of several yarn guide bars and a needle bar mounted for longitudinal and transverse reciprocation with respect to one another to perform various knitting manipulations of the yarns to form a cohesive fabric which is then withdrawn from the area of the knitting mechanism 28 over a series of guide and tensioning rollers 30 for winding onto a suitable tube or core, typically cradled between a pair of elongate support rollers (not shown) extending along the length of the machine 22 at its front side (as viewed in FIG. 1).

In accordance with the present invention, the take-up apparatus 20 replaces the conventional cradle-type take-up arrangement of the warp knitting machine 22. Basically, the take-up apparatus 20 comprises a catwalk assembly, broadly indicated at 32 and shown in greater detail in FIGS. 3 and 4, situated on the floor to extend along the entirety of the front side of the warp knitting machine 22, an A-frame winding structure 34 for disposition alongside the catwalk assembly 32, and a drive dolly assembly 36 for disposition at and connection with one end of the A-frame structure 34. Briefly described, one fundamental concept of the present invention is that the A-frame winding structure 34 is separable from the catwalk assembly 32 and, in turn, from the knitting machine 22 so that, once the structure has been wound to its maximum capacity with fabric F produced by the warp knitting machine 22, the A-frame structure 34 can be separated from and moved to any other desired location remote from the knitting machine 22 for fabric storage, feeding the fabric into a subsequent processing or finishing station, etc., depending upon the preferences and practices of the fabric producing facility. To accommodate this basic purpose, the A-frame winding structure 34 is not mechanically connected to the catwalk assembly 32 or the knitting machine 22 and is supported on wheels for ease of movement to and from the knitting machine 22 and, further, the drive dolly assembly 36 is separable from the A-frame winding structure 34 and is also mounted on wheels to facilitate transportation of the A-frame winding structure 34 as well as any transporting movement of the drive dolly assembly 36 itself, all as will be more fully described hereinafter. A central microprocessor 35 or other suitable programmable controller or computer is provided for operational control of the catwalk assembly 32 and the drive dolly assembly 36, as more fully described hereinafter.

The catwalk assembly 32 is mounted rigidly to the frame 24 of the warp knitting machine 22 along its front side, i.e., the fabric take-off side of the machine. Basically, the catwalk assembly 32 comprises a horizontally-extending, floor-supported frame 38 extending along the length of the warp knitting machine 22 with a fabric transfer arm assembly 40 pivotably affixed to the frame 38 at the side thereof opposite the warp knitting machine 22. One or more curbs or guide channels 42 are mounted to the floor at the outward side of the catwalk assembly 32 to receive a wheel or wheels of the A-frame winding structure 34 for purposes of precisely positioning the winding structure with respect to the catwalk assembly 32. In such disposition, the fabric transfer arm assembly 40 is pivotable and extensible-retractable relative to the A-frame winding structure 34 to deliver and apply the fabric from the knitting machine 22 peripherally onto a lengthwise winding roll 44 of the A-frame structure.

More specifically, the A-frame winding structure 34 includes an elongate rectangular base frame 46 supported on wheels 48 at the corners of one frame end and on rigid feet 50 at the corners of the opposite frame end. Upright support arms 52 are rigidly affixed to, and extend convergingly upwardly from, the opposite end corners of the base frame 46, generally forming the shape of an A, hence the reference to the structure as an A-frame. The converging upper ends of each pair of support arms 52 carry respective bearing assemblies which rotatably support the opposite ends of a shaft 56 on which the aforementioned winding roll 44 is supported. At least one end of the shaft 56 extends outwardly from the respective bearing 54 and is peripherally configured with splines (not shown) to permit selective connection and disconnection to and from the drive dolly assembly 36, as described hereinafter.

Figure 3:
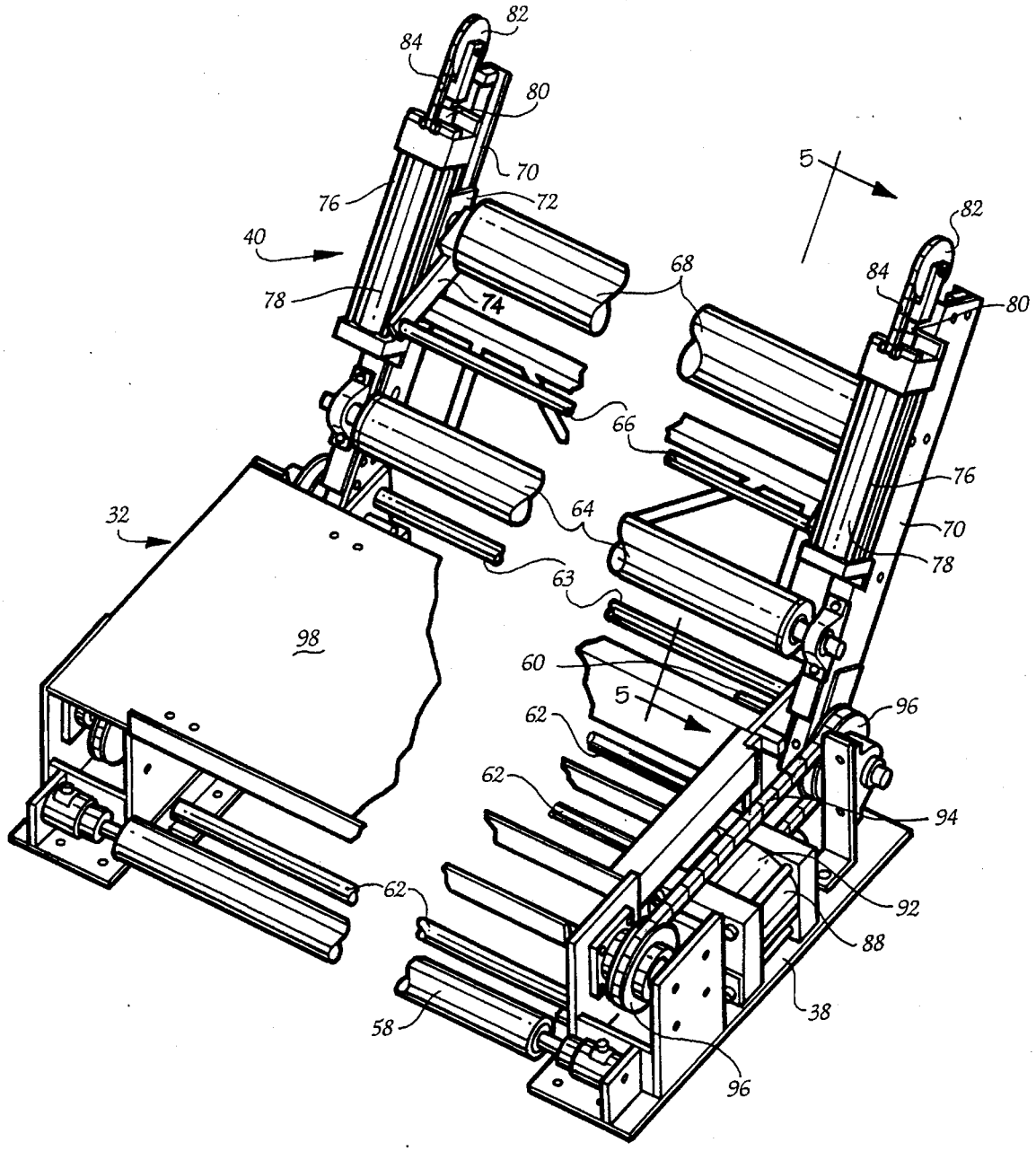
FIG. 3 is a perspective view of a catwalk assembly forming part of the take-up apparatus of FIGS. 1 and 2.
Figure 4:
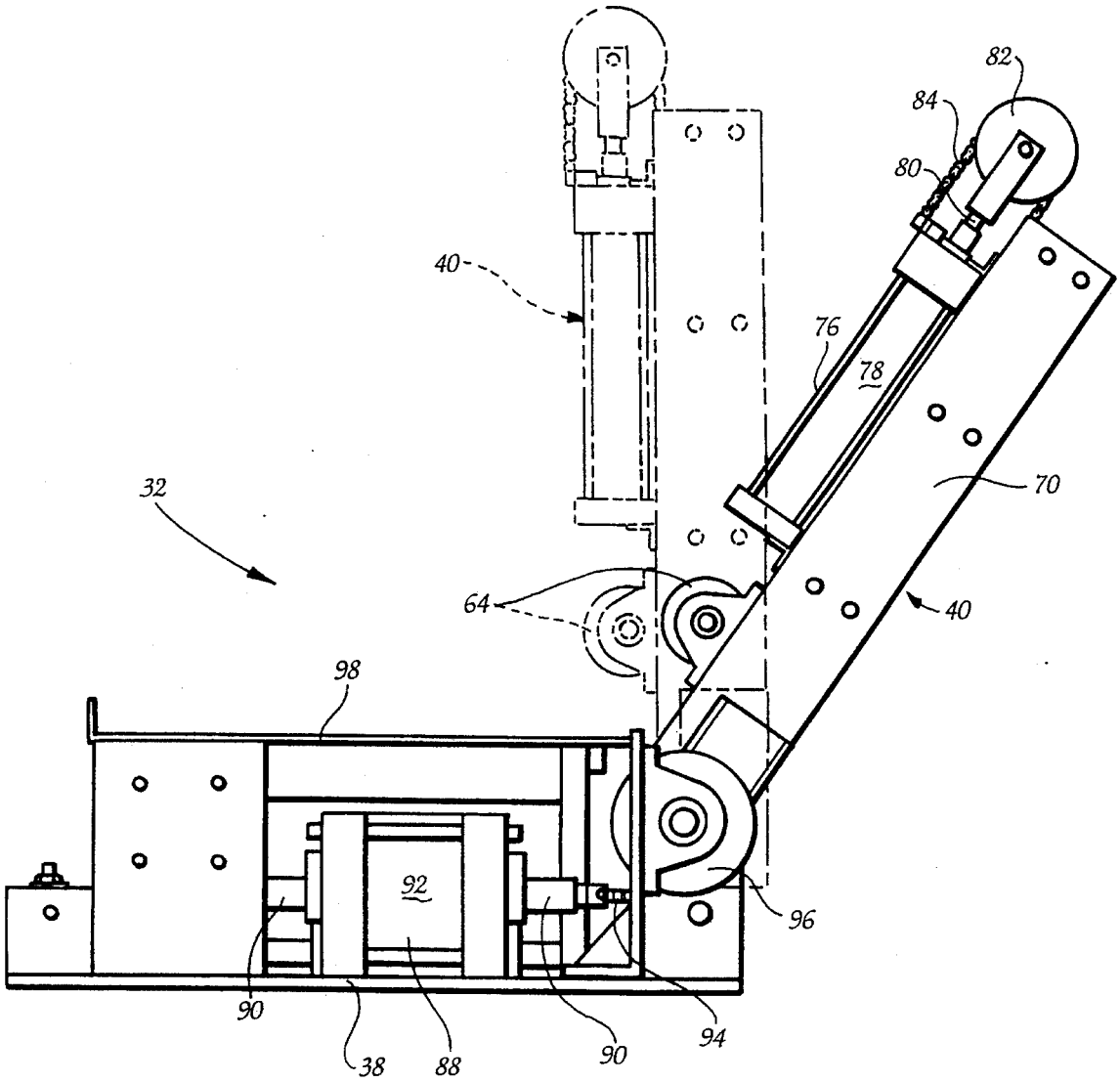
FIG. 4 is an end elevational view of the catwalk assembly of FIG. 3.
Figure 5:
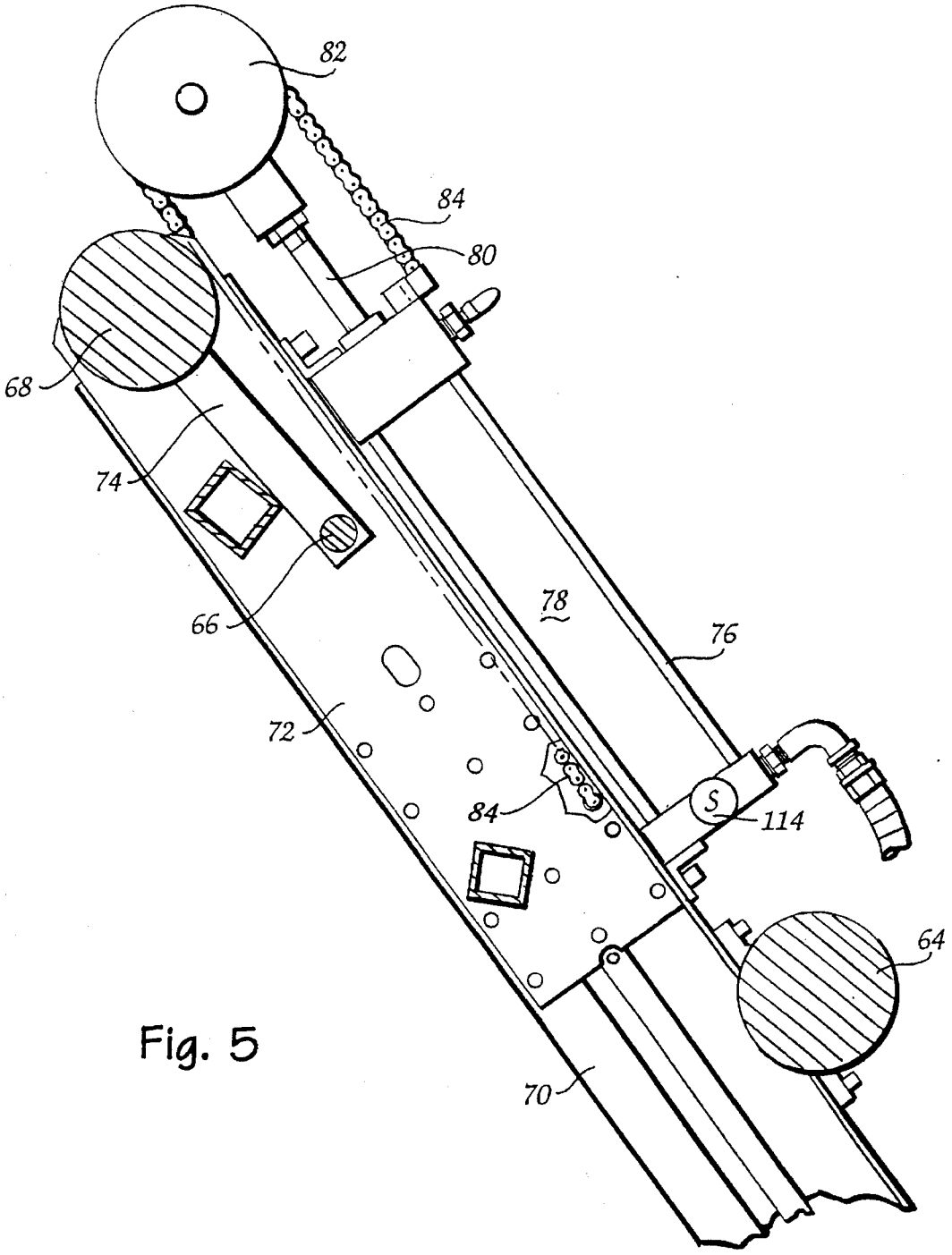
FIG. 5 is a vertical cross-sectional view of the catwalk assembly of FIGS. 3 and 4, taken along line 5—5 of FIG. 3.

The catwalk assembly 32 is best seen and understood with reference to FIGS. 3–5. The horizontal floor-supported frame 38 of the catwalk assembly 32 rotatably supports a pair of elongate guide rollers 58,60 extending along the respective rearward and forward sides of the frame 38, a series of three elongate fabric decurling bars 62 disposed intermediate the guide rolls 58,60, and a guide bar 63 at the forward side of the frame 38 directly above the roller 60, all in parallel relation to one another and to the guide rollers 30 of the warp knitting machine 22. The fabric transfer arm assembly 40 is pivoted to the frame 38 co-axially with the forward guide roll 60 and the arm assembly 40 carries an elongate guide roll 64 adjacent the pivoted end of the arm assembly, an elongate fabric decurling bar 66, and an elongate fabric transfer roll 68 adjacent the outward end of the arm assembly 40, each also in parallel relation to one another and to the guide rolls and decurling bars 58,60,62 within the catwalk frame 38. Each of the guide rolls 58,60, 64,68 are freely rotatable idler rolls so as to be rotated by peripheral contact with the traveling fabric and thereby minimize frictional forces on the fabric. The decurling bars 62,66 are fixed and non-rotatable so that peripheral frictional contact with the traveling fabric will tend to prevent the opposite side edges of the fabric from curling, but are of relatively small diameter to minimize the frictional forces thereby created.

The fabric transfer arm assembly 40 has a pair of laterally spaced parallel arms 70, each of which is in the form of a channel configuration within which a carriage 72 is slidably supported for extending and retracting movement relative to the arms 70. Stub shafts at opposite ends of the fabric transfer roll 68 are rotatably supported by the outer ends of the respective carriages 72 for extending and retracting movement therewith. The fabric decurling bar 66 is supported on a pair of legs 74 rotatably supported about the stub shafts of the fabric transfer roll 68 and extending radially therefrom toward the guide roll 64, for extending and retracting movement of the decurling bar 66 integrally with the carriages 72 and the fabric transfer roll 68.

A pair of piston and cylinder assemblies 76 are supported on the respective arms 70 to actuate extending and retracting movement of the carriages 72 and, in turn, extending and retracting movement of the fabric transfer roll 68 and the decurling bar 66. Each piston-and-cylinder assembly 76 has its cylindrical body 78 affixed rigidly to the respective arm 70 with the piston 80 oriented for linear extension and withdrawal relative to the cylinder 78 in parallel relation to the sliding movement of the carriage 72. A toothed pulley 82 is affixed to the outer end of each piston and has a length of chain 84 trained in meshing engagement about the pulley 82, with one end of the chain 84 affixed to the body of the cylinder 78 and the other end of the chain 84 affixed to the respective carriage 72. In this manner, extension and retraction of the piston 80 actuates outward and inward sliding movement of the carriage 72. By selection of the length of the chain 84, the actual range of movement of the carriage 72 relative to the arms 70 can be selectively varied. Each piston and cylinder assembly 76 is operated pneumatically from a suitable source of compressed air (not shown) which, in turn, is controlled by the central microprocessor 35.

The fabric transfer arm assembly 40 is pivotable between an operative fabric winding position shown in full lines in FIGS. 1–5 and an inoperative thread-up position shown in broken lines in FIG. 4. The forwardly facing support arms 52 of the A-frame winding structure 34 have laterally extending flanges 86 (see FIG. 6) against which the arms 70 of the fabric transfer arm assembly 40 abut and rest in the operative winding position to dispose the arm assembly 40 for extending and retracting movement of its carriage 72 and fabric transfer roll 68 along a radius of the winding roll 44. Pivoting movement of the transfer arm assembly 40 is actuated by a double acting piston and cylinder assembly 88 housed within the frame 38 of the catwalk assembly 32. The piston and cylinder assembly 88 has a pair of piston rods 90 extending outwardly from oppositely sides of the cylinder housing 92, with the rods 90 being attached to the respective opposite ends of a drive chain 94. The drive chain 94 is trained about a pair of toothed pulleys 96 at the opposite forward and rearward sides of the frame 38, the forward pulley 96 being affixed to the pivot shaft of the arm assembly 40. Compressed air operation of the piston and cylinder assembly 88 is controlled by the microprocessor 35 to in turn actuate pivoting movement of the arm assembly.

The horizontal floor-supported frame 38 of the catwalk assembly 32 is covered at its upwardly facing side by a series of rigid plates 98, whereby a machine operator is enabled to walk back and forth through the area directly above the housing 38 and between the knitting machine 22 and the A-frame winding structure 34 as necessary or desirable to inspect and/or perform any necessary operations on the knitting machine 22.

Figure 7:
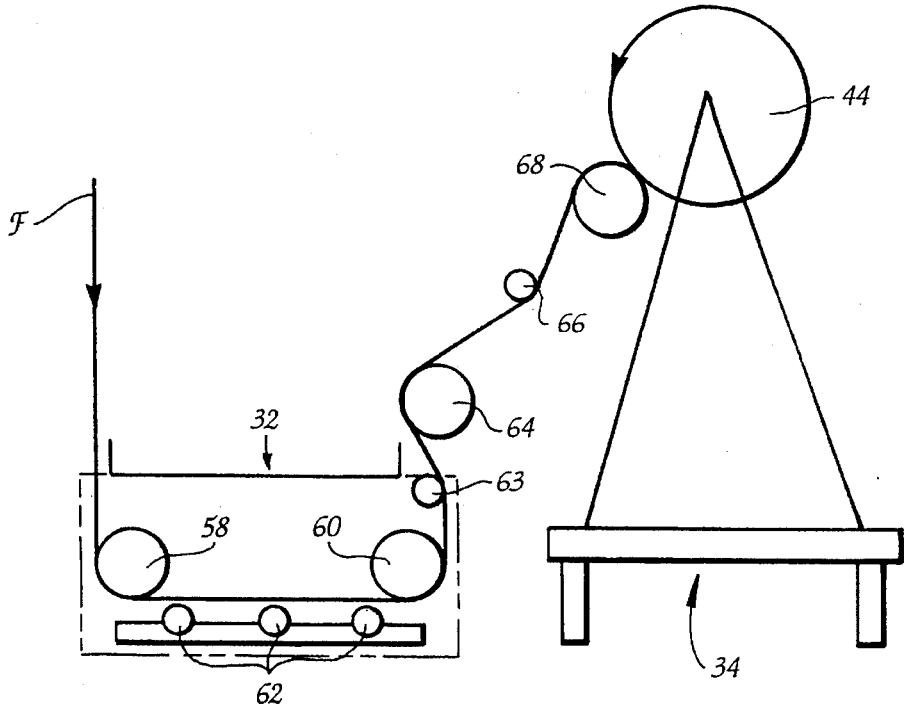
FIG. 7 is a schematic end elevational view of the combined take-up apparatus and warp knitting machine of FIGS. 1 and 2, showing one possible fabric thread-up arrangement.
Figure 8:
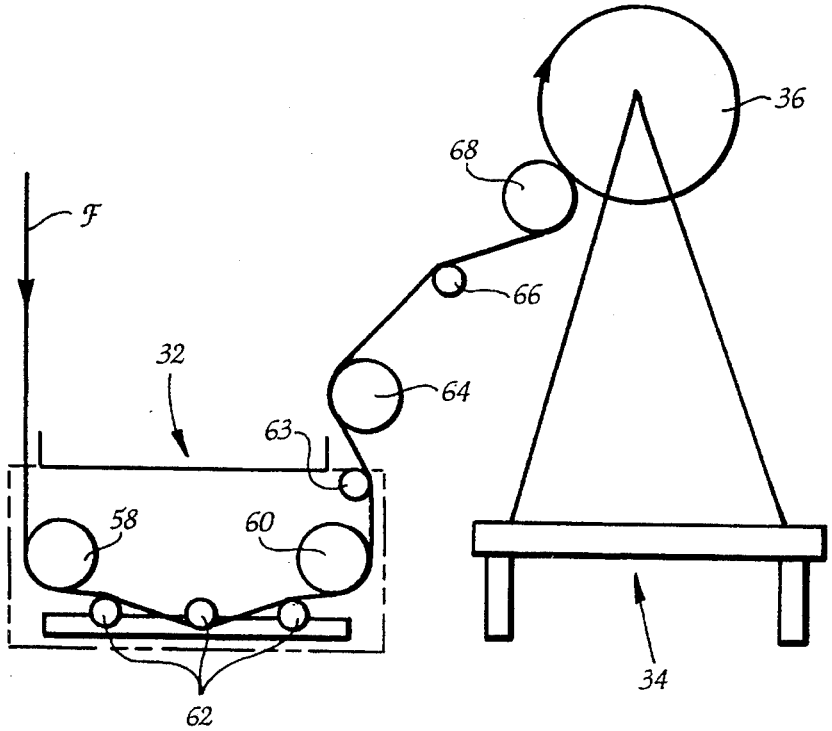
FIG. 8 is a schematic end elevational view similar to FIG. 7, showing an alternative possible fabric thread-up arrangement.

FIGS. 7 and 8 schematically illustrate alternative arrangements for thread-up of fabric through the catwalk assembly 32 for winding onto the roll 44 of the A-frame structure 34. In each arrangement, the fabric F delivered from the knitting machine 22 travels downwardly in peripheral contact about the guide roll 58, horizontally therefrom into peripheral contact about the guide roll 60, and upwardly therefrom in serial peripheral contact with the guide bar 63, the guide roll 64, the fabric decurling bar 66, and finally, the fabric transfer roll 68 which is extended into peripheral contact with the winding roll 44 of the A-frame winding structure 34 to apply the fabric F thereto for winding thereabout. In the arrangement of FIG. 7, the fabric F is directed from the guide roll 64 about the forward side of the decurling bar 66 and the rearwardly facing side of the transfer roll 68 so that the fabric F is wound in a counterclockwise direction about the winding roll 44 (as viewed in FIG. 7). In FIG. 8, the fabric F is instead directed about the rearwardly-facing side of the decurling bar 66 and the forwardly-facing side of the transfer roll 68 for clockwise winding about the roll 44. In either case, the fabric F can optionally be threaded over and under the series of decurling bars 62, as shown in FIG. 8, or alternatively can travel directly between the guide rolls 58,60, as shown in FIG. 7, as necessary or desirable for fabric decurling purposes in any given winding operation.

Figure 6:
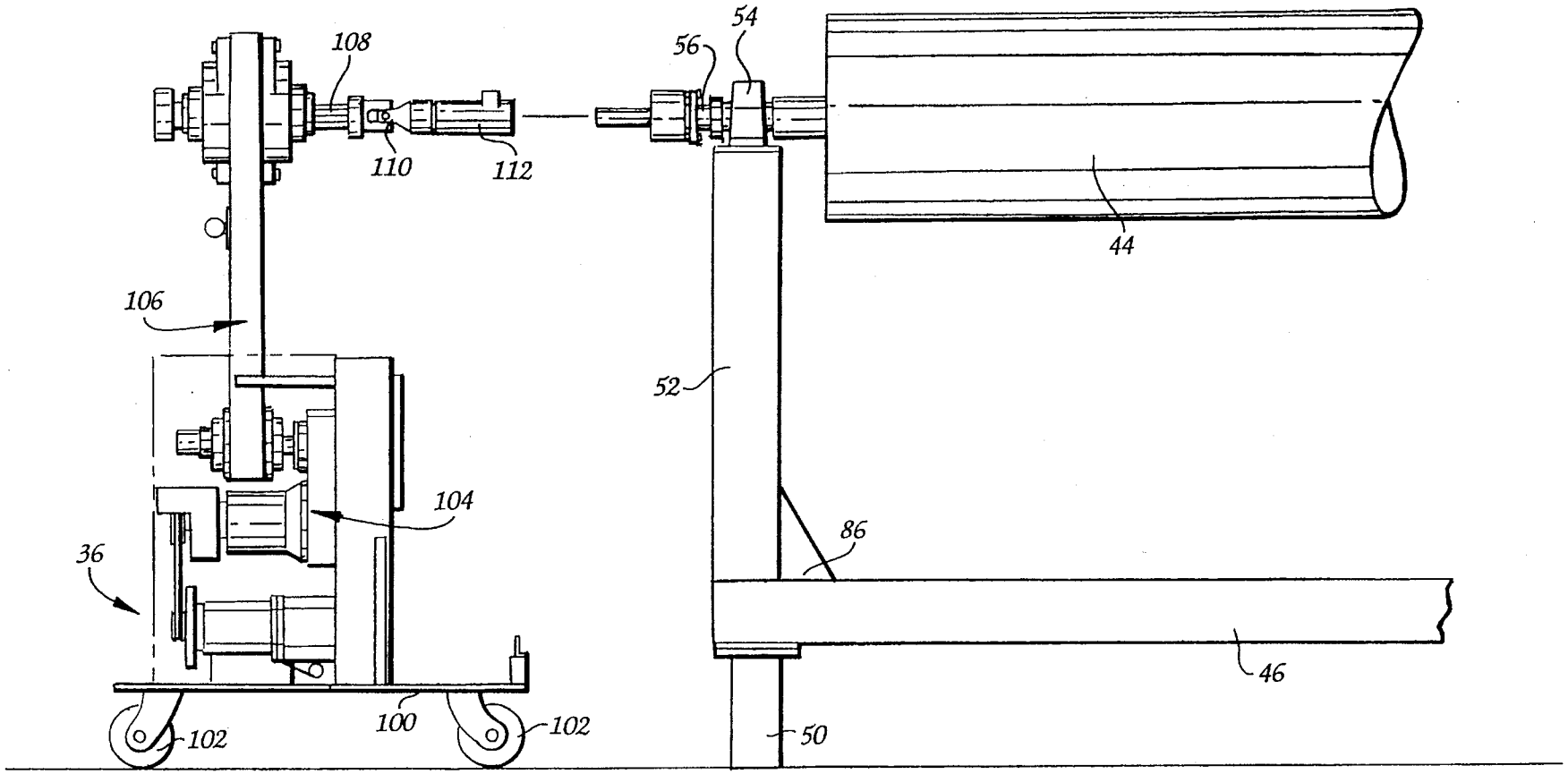
FIG. 6 is a front elevational view of a drive dolly assembly forming part of the take-up apparatus of FIGS. 1 and 2.

During any such winding operation, the drive dolly assembly 36 is connected with the shaft 56 of the A-frame winding structure 34 to drive the clockwise or counterclockwise rotation of the winding roll 44. As best seen in FIG. 6, the drive dolly assembly 36 includes a base frame 100 supported on floor-contacting wheels 102, with a drive motor assembly 104 mounted on the base frame 100. The drive motor assembly 104 is connected through a chain drive mechanism 106 with a horizontally extending drive shaft 108, the outward end of which carries a universal joint 110 and a spline sleeve 112 for connection with the splined end of the shaft 56 on the A-frame winding structure 34. In this fashion, the drive dolly assembly 36 can be selectively connected and disconnected through the universal joint and connecting sleeve assembly 110,112 to and from the A-frame winding structure 34. The drive motor assembly 104 is a variable speed controllable electric motor enabling precise variable control of the driven speed of the A-frame shaft 56, e.g., a precision brushless direct-current drive motor, the drive speed of which is controlled by the microprocessor 35 as will be presently described.

As will be understood by the persons skilled in the art, one of the disadvantages of conventional fabric take-up mechanisms utilized with textile warp knitting machines as well as in other fabric producing apparatus is the inability of the take-up mechanisms to provide precise control of fabric tension during the winding process. Tension fluctuations in the fabric can even affect the fabric quality, especially if relatively large rolls of fabric are wound and, accordingly, it is common conventional practice to doff wound fabric from the knitting machine in relatively small rolls. The present invention overcomes this disadvantage and enables the winding of much larger than conventional rolls of fabric through precise sensing and control of fabric tension.

Specifically, the guide roll 58 of the catwalk assembly 32 is preferably in the form of a transducer roller assembly basically comprising an outer roll shell supported for free rotation about a central roll shaft, the opposite ends of which are supported in annular bearing-like transducer units. The transducer units act in the nature of a weight scale to measure the weight of the transducer roller continuously throughout the fabric producing and winding operation, whereby changes in the measured weight of the transducer roller reflect fluctuating increases and decreases in the fabric tension. The transducer units are connected to the microprocessor 35 to deliver signals representing the measured transducer roll weight and the microprocessor 35 is programmed to adjustably control appropriate increases and decreases in the driven speed of the drive motor assembly 104 of the drive dolly 36 as necessary to counteract the tension fluctuations reflected by the weight signals of the transducer guide roll 58.

In this manner, the tension of the fabric F can be precisely controlled and maintained substantially uniform throughout the fabric winding process, which is especially important with fabrics which may be relatively sensitive to tension variations, such as stretchable and plush or pile fabrics. Those persons skilled in the art will also recognize that, with some fabrics and in certain circumstances, it may be desirable to intentionally vary fabric tension from the beginning to conclusion of, or at stages during, the overall fabric winding operation. For example, it may be desirable to progressively decrease fabric tension in controlled incremental steps or even linearly over the course of a winding operation. Advantageously, the programmability of the microprocessor 35 in conjunction with the ability to control tension utilizing the signals from the transducer guide roll 58 enable the microprocessor 35 to predetermine and then execute substantially any desirable tension program as a winding operation progresses.

It will also be apparent that, as any fabric winding operation progresses, the overall diameter of the wound fabric on the A-frame winding roll 44 will progressively increase and, in turn, the carriage 72 and fabric transfer roll 68 of the transfer arm assembly 40 should be progressively retracted to maintain a substantially constant force of contact by the transfer roll 68 with the periphery of the wound fabric on the winding roll 44. The microprocessor 35 is hereagain programmed to control the delivery of compressed air to the piston and cylinder assembly 76 to, in turn, control the extension and retraction of the carriage 72 and fabric transfer roll 68 for this purpose. Specifically, the piston-and-cylinder assembly 76 is equipped with a sensor, indicated only representatively at 114 in FIG. 5, which continually monitors the internal air pressure within the cylinder housing 78 and delivers signals to the microprocessor 35 representing the detected pressure, the microprocessor 35 in turn adjustably decreasing the delivery of compressed air to the cylinder as necessary to relieve pressure increases which occur as the natural result of the progressively increasing wound fabric diameter and thereby to maintain the internal air pressure within the cylinder 78 substantially constant so that the force of peripheral contact by the transfer roll 68 with the wound fabric on the A-frame winding roll 44 is kept substantially constant. Hereagain, if and as necessary or desirable, the microprocessor 35 also enables the contacting force exerted by the transfer roll 68 to be controllably varied during the winding operation.

Advantageously, the programmable control by the microprocessor of fabric tension and peripheral fabric application force over the course of a fabric winding operation, in conjunction with the provision of the transportable A-frame winding structure of the present invention, enables warp-knitted fabric to be wound directly from the knitting machine into substantially larger rolls and with much more precisely controlled fabric tension and winding compaction than is possible with any known knitting machine take-up mechanism or any other known take-up mechanism of a fabric producing machine. The transportability of the A-frame winding structure enables the thusly-produced wound rolls of fabric to be transported by means of the structure directly to a subsequent fabric treatment, processing, or finishing operation without the conventional necessity of rewinding the fabric as an intermediate step to subsequent processing. By way of example, but without limitation, it is contemplated that the A-frame winding structure 34 could be utilized to support and wind fabric directly onto a conventional fabric dyeing tube whereby a wound roll of fabric could be transported by the A-frame winding structure directly to a dyeing operation. Those persons skilled in the art will readily recognize that the present fabric take-up apparatus thereby enables significant cost savings and improved efficiency to be achieved, in addition to enhancement of fabric quality by improved precision in the winding operation.

Figure 9:
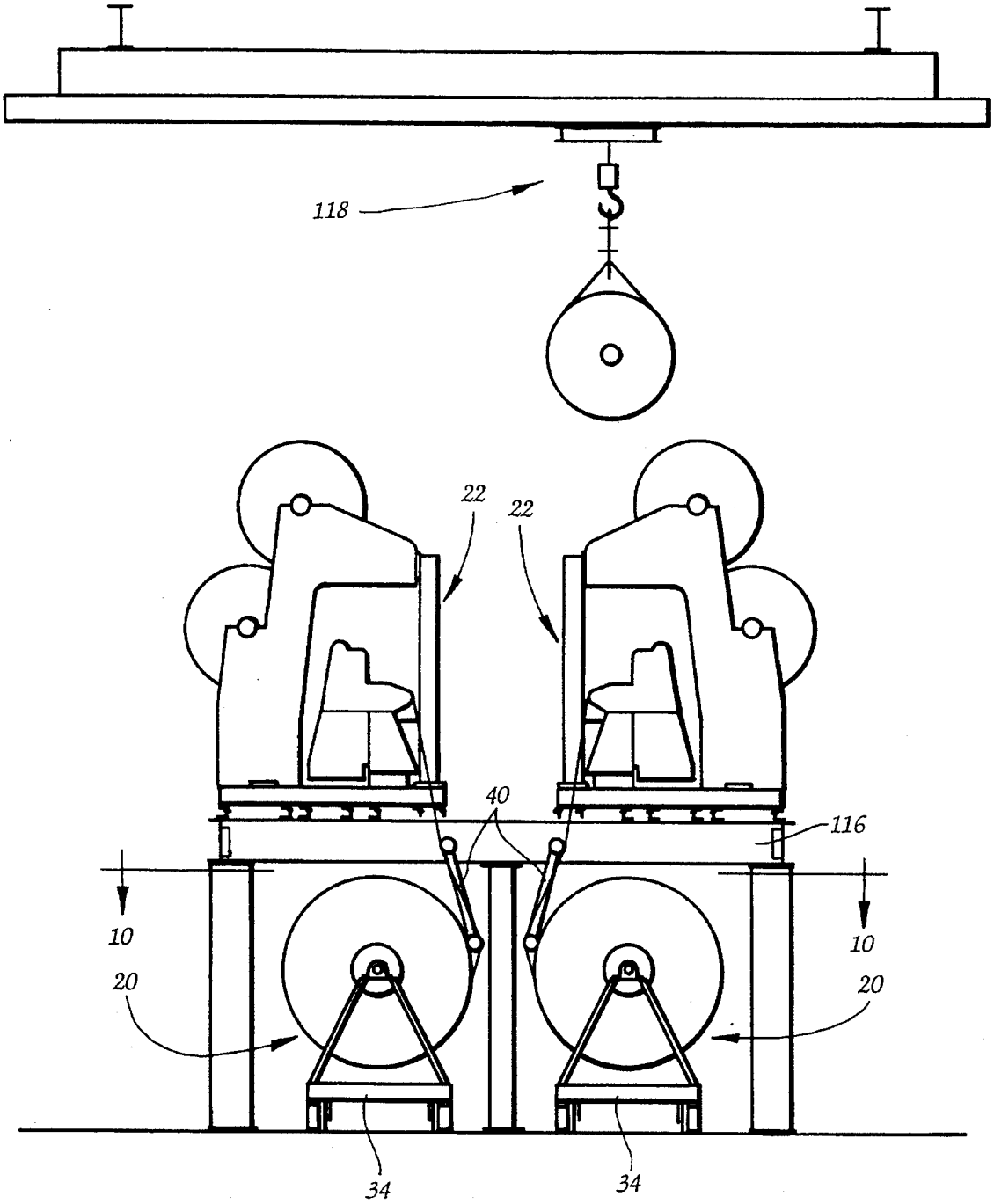
FIG. 9 is a schematic end elevational view of an alternative embodiment of the present take-up apparatus in combination with a warp knitting machine.
Figure 10:
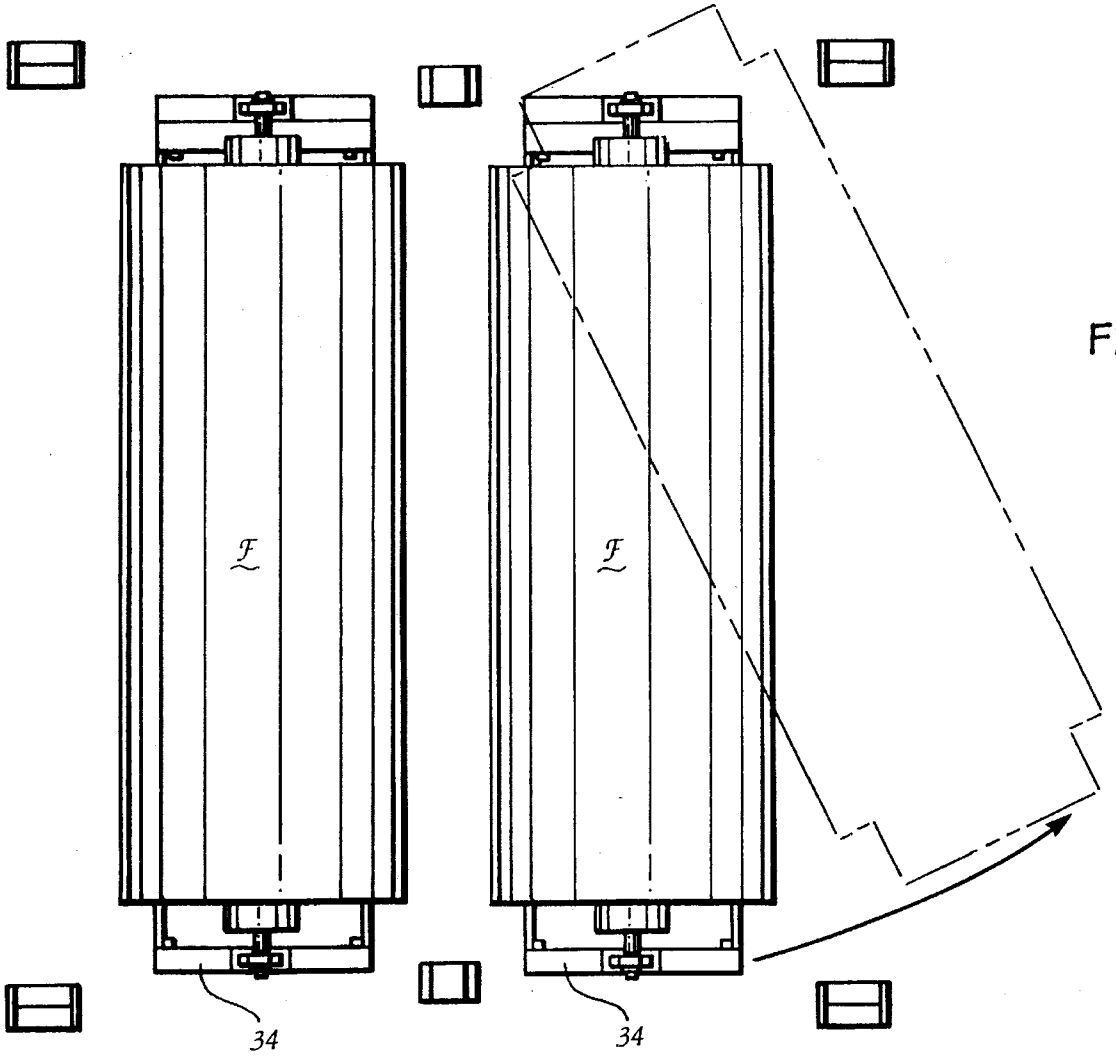
FIG. 10 is a schematic horizontal cross-sectional view of the take-up apparatus of FIG. 9, taken along 10—10 thereof.
Figure 11:
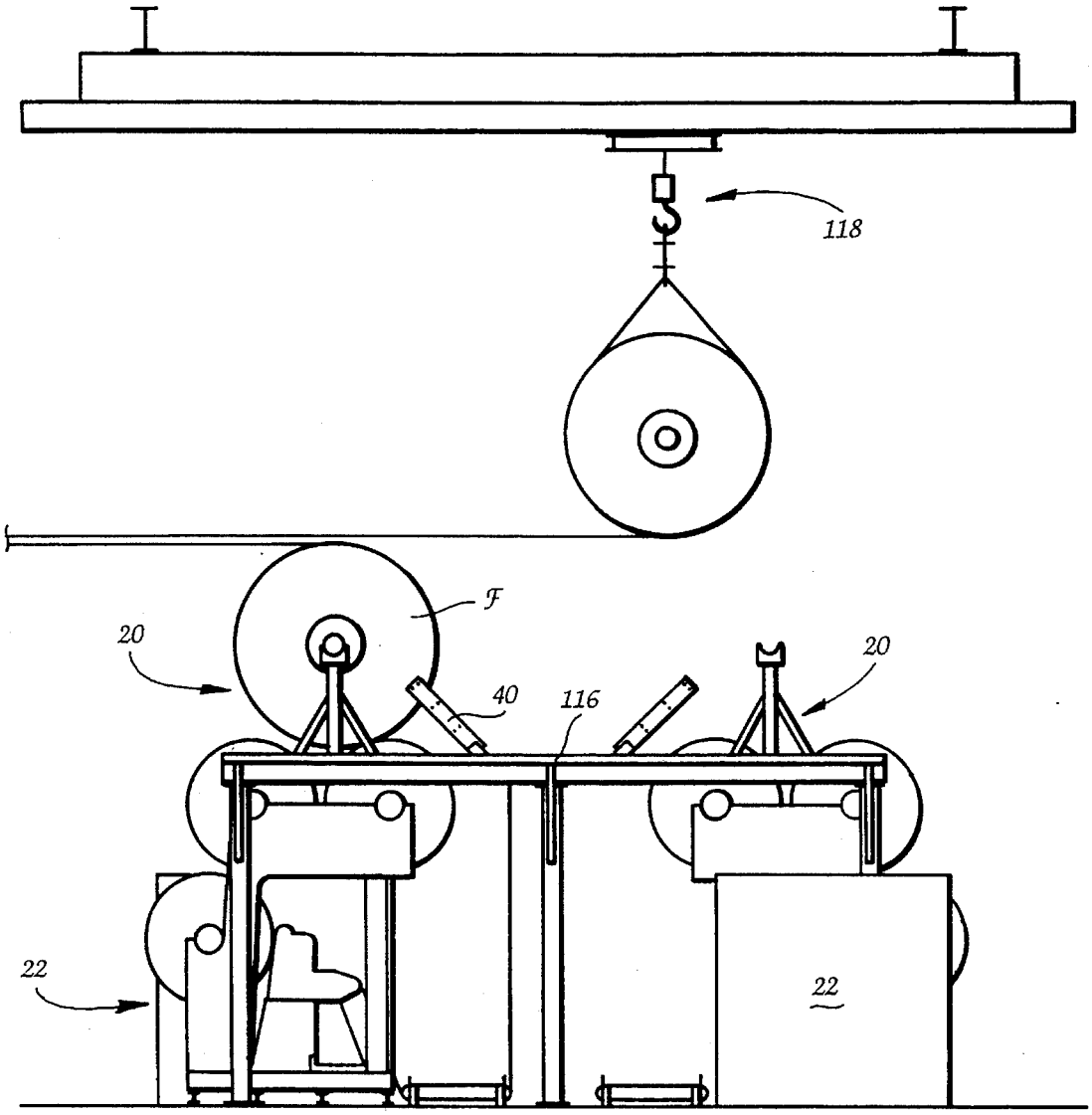
FIG. 11 is another schematic end elevational view of a further embodiment of the present take-up apparatus in combination with a warp knitting machine.

It is further contemplated that these advantages of the present invention could provide the foundation enabling further improvements and enhancements in the civil engineering of the layout of textile mills. FIGS. 9–11 schematically illustrate other possible embodiments of the present fabric take-up apparatus in combination with warp knitting machines which representatively illustrate such possibilities. Conventionally, all textile mill machinery and equipment is floor-supported within the mill building and, quite often, a substantial amount of overhead space within the building is unutilized and essentially wasted. FIG. 9 illustrates an embodiment made possible by the present invention wherein the warp knitting machines 22 within a knitting room could be elevated above the floor of the room, for example, by an elevated system of structural support beams 116, with the A-frame winding structure 34 for each knitting machine 22 supported on the knitting room floor directly beneath its associated knitting machine and with the fabric transfer arm assembly 40 mounted to the structural beam system 116 rather than to a catwalk assembly 32 as in the above-described embodiment. In this embodiment, the A-frame winding structures could be transported over the knitting machine floor to a subsequent processing location after the conclusion of a winding operation or, alternatively, could remain in place and simply be swingable laterally from their winding position shown in FIG. 9 into a position suitable for doffing of the wound fabric roll from the A-frame structure, as schematically depicted in FIG. 10. A crane system movable throughout the knitting room by means of an elevated motorized track system, as generally indicated at 118, could be utilized to deliver replacement warp beams and doff empty warp beams to and from the knitting machines.

FIG. 11 depicts a further embodiment which is essentially the reverse of the embodiments of FIGS. 9 and 10, i.e., with the warp knitting machines 22 situated on the knitting room floor and the A-frame winding structures situated directly thereabove on an elevated system of structural support beams 116, the transfer arm assembly 40 again being mounted to the support beam system rather than to a catwalk assembly. Advantageously, in this embodiment, doffing of the wound fabric roll could be accomplished by lifting the rolls from their respective A-frame structures at the completion of a winding operation by means of an overhead crane structure 118 movable throughout the knitting room on a motorized trackway.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In combination with a textile fabric producing machine, a fabric take-up apparatus comprising a fabric take-up frame, a fabric take-up roll supported on the frame for winding of fabric thereabout, means for variably driving rotation of the take-up roll, means for monitoring tension in the fabric between the fabric producing machine and the take-up frame, and means operatively associated with the tension monitoring means for controlling the driving means to maintain tension in the fabric according to a predetermined tension program as the fabric is wound on the take-up roll, wherein the tension monitoring means comprises a take-off roll adjacent the fabric producing machine for peripherally contacting the fabric and means associated with the take-off roll for detecting deflections of the take-off roll resulting from fabric tension fluctuations, and an applying means is arranged for peripherally applying the fabric to the take-up roll at a peripheral location thereon facing the take-off roll for reducing the distance of fabric travel between the take-off and take-up rolls, the take-up frame being separable from and movable independently of the fabric producing machine for transporting a fabric after a take-up operation to a subsequent processing station without rewinding of the fabric.

2. The combination of claim 1, wherein the tension program of the controlling means is operative to maintain a substantially constant tension in the fabric as it is wound on the take-up roll.

3. The combination of claim 1, wherein the tension program of the controlling means is operative to vary the tension in the fabric as it is wound on the take-up roll.

4. The combination of claim 1, wherein the applying means comprises a fabric application roll for peripherally contacting the outer layer of fabric on the take-up roll and means for maintaining a predetermined force of contact by the fabric application roll against the fabric on the take-up roll.

5. The combination of claim 4, wherein the applying means includes means for moving the fabric application roll toward and away from the take-up roll and means for controlling movement of the fabric application roll in relation to the diametric dimension of the wound fabric on the take-up roll.

6. The combination of claim 5, wherein the roll moving means comprises a fluid-actuated piston-and-cylinder assembly to which the fabric application roll is connected and the controlling means comprises means for monitoring the fluid pressure within the piston-and-cylinder assembly and means for actuating extension and withdrawal of the piston to maintain the fluid pressure substantially constant.

7. The combination of claim 1, wherein the driving means comprises a drive frame separable from the take-up frame, a drive motor mounted to the drive frame, and means for selectively connecting and disconnecting the drive motor to and from the take-up roll.

* * * * *